US006206540B1

(12) United States Patent
Vogel

(10) Patent No.: US 6,206,540 B1
(45) Date of Patent: Mar. 27, 2001

(54) CANDELABRA

(76) Inventor: Jon A. Vogel, 2993 Lawndale St., Las Vegas, NV (US) 89121

( * ) Notice: Subject to any disclaimer, the term of this patent is extended or adjusted under 35 U.S.C. 154(b) by 0 days.

(21) Appl. No.: 09/303,534

(22) Filed: Apr. 30, 1999

(51) Int. Cl.[7] ..... F21V 35/00

(52) U.S. Cl. ..... 362/161; 362/258; 362/382; 431/295; 431/297

(58) Field of Search ..... 362/382, 392, 362/458, 161, 564, 228; 211/60.1; 248/146, 436, 176.1, 176.2, 511, 519, 539; 431/288, 289–297

(56) References Cited

U.S. PATENT DOCUMENTS

| | | | | |
|---|---|---|---|---|
| 401,592 | * | 4/1889 | Roelofs | 431/294 |
| 1,975,522 | | 10/1934 | Swobe | 431/295 |
| 2,158,531 | | 5/1939 | Brennan | 206/19 |
| 3,091,106 | | 5/1963 | Crouch | 431/290 |
| 3,368,693 | | 2/1968 | Bochory | 211/133.6 |
| 3,695,458 | | 10/1972 | Nagel | 211/194 |
| 3,942,940 | | 3/1976 | O'Shea | 431/291 |
| 4,124,122 | * | 11/1978 | Emmitt | 211/74 |
| 4,260,365 | | 4/1981 | Kayne | 431/291 |
| 4,362,325 | | 4/1981 | Garcia | 362/121 |
| 4,406,616 | | 9/1983 | Greenvourcel | 431/295 |
| 4,569,655 | | 2/1986 | Charette | 431/290 |
| 4,759,699 | | 7/1988 | Rubarth | 431/291 |
| 4,894,008 | | 1/1990 | Lee | 431/290 |
| 4,921,421 | | 5/1990 | Little | 431/295 |
| 5,086,380 | | 2/1992 | Hedner, Jr. | 362/161 |
| 5,124,903 | * | 6/1992 | Coviello | 362/392 |
| 5,452,810 | * | 9/1995 | Schwartz | 211/74 |

* cited by examiner

*Primary Examiner*—Thomas M. Sember
*Assistant Examiner*—Ismael Negron
(74) *Attorney, Agent, or Firm*—Kenneth L Tolar

(57) ABSTRACT

A candelabra for securely supporting a candle in an upright position includes a lower support platform and an upper support platform mounted above said lower support platform. The upper support platform includes a plurality of apertures for receiving a candlestick. The lower support platform includes a plurality of indentions each aligned with a corresponding aperture on the upper support platform. A candle may be securely supported in an upright position by inserting the lower end of the candlestick through the aperture on the upper support platform and subsequently into the indention on the lower support platform. The upper and lower support platforms are connected with removably attached brace members allowing the device to be easily disassembled.

8 Claims, 3 Drawing Sheets

CANDELABRA

BACKGROUND OF THE INVENTION

The present invention relates to a candelabra designed to support prayer candles in an upright position preventing them from being overturned.

DESCRIPTION OF THE PRIOR ART

When in use, candles are typically mounted in a candle holder. Conventional candle holders include a receptacle for receiving the lower end of the candle. However, mounting candles in such a fashion makes them susceptible to being overturned by toddlers, wind or similar external forces. If the candle is lit, the situation can be extremely dangerous in that the overturned candle could cause a fire. Prayer candles are even more dangerous in that such candles are often rested on a table or similar surface with no external supporting means. The present invention overcomes the above described disadvantages of conventional candle holders by providing a uniquely configured candelabra designed to securely retain a prayer candle in an upright position.

Various candelabras exist in the prior art. For example, U.S. Pat. No. 5,086,380 issued to Hedner, Jr. relates to a glass bowl filled with a liquid that is adapted to receive a candlestick.

U.S. Pat. No. 4,921,421 issued to Little relates to a candelabrum including flat, steel straps bent into a semicircular form. The free ends of the straps are bent toward each other forming a candle ledge having candle cups secured therealong.

U.S. Pat. No. 4,406,616 issued to Greenvourcel relates to a set of modular elements particularly useful for assembling candelabra.

U.S. Pat. No. 3,695,458 issued to Nagel relates to a modular candelabrum having at least three connecting legs. The upper ends of the legs are provided with a socket that is capable of interconnecting with another socket.

U.S. Pat. No. 3,368,693 issued to Bochory relates to a centerpiece tray with swiveling candle holders.

U.S. Pat. No. 3,091,106 issued to Crouch relates to a tripod type candelabra.

Although various candelabras exist in the prior art, the devices are not specifically designed to prevent a candle from being overturned. The present invention provides a unique, dual-tiered candle holder designed to securely support a candle in an upright position.

SUMMARY OF THE INVENTION

The present invention relates to a candelabra designed to support a prayer candle in an upright position. The device comprises an upper support platform mounted a predetermined distance above a lower support platform. The upper support platform includes a plurality of apertures, each dimensioned to receive a candlestick. The lower platform includes a plurality of spaced indentions on its upper surface dimensioned to receive the lower end of a candlestick. Each indention is vertically aligned with a corresponding aperture on the upper support platform. Received within each indention is a heat shield member. The candlestick is supported in an upright position by inserting the lower end through an aperture on the upper support member and an aligned indention on the lower platform. It is therefore an object of the present invention to provide a candelabra that securely supports a candlestick in an upright position.

It is another object of the present invention to provide a candelabra that is simple and inexpensive to manufacture.

It is yet another object of the present invention to provide a candelabra that may be disassembled for storage. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
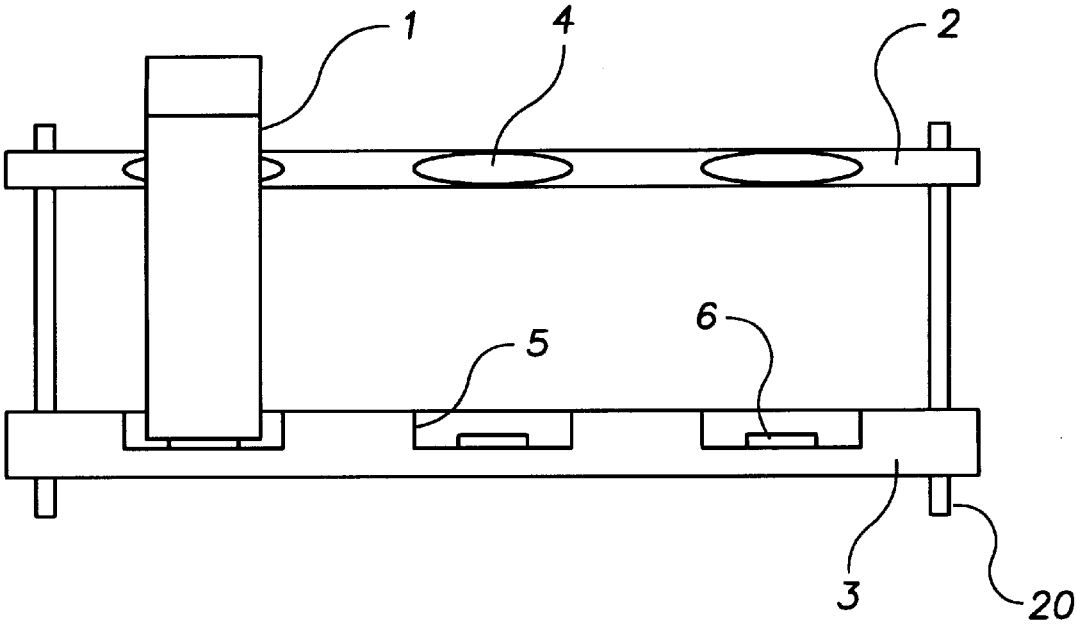
FIG. 1 is a front cross-sectional view of the device.

Referring now to FIGS. 1 through 4, the present invention relates to a candelabra for supporting a candlestick 1 such as a prayer candle in an upright position. The device comprises a substantially rectangular upper support platform 2 and a substantially rectangular lower support platform 3. The upper support platform is mounted a predetermined distance above the lower support platform. The upper support platform includes a plurality of aligned apertures 4 each dimensioned to receive or surround a candlestick.

The lower support platform includes a plurality of spaced circular indentions 5 each dimensioned to receive the lower end of a candlestick. Each indention is vertically aligned with a corresponding aperture on the upper support platform. Received within each indention is a substantially circular plate 6 constructed with ceramic, a high temperature plastic or a similar material. The lower end of the candlestick rests on the upper surface of the plate to elevate the candle above the bottom of the indention thereby shielding the platform from extreme heat. On the bottom surface of the lower support platform are a plurality of support legs 20 for suspending the platform above a supporting surface. Accordingly, a candle is supported in an upright position by inserting the lower end through an aperture on the upper support platform and then into the aligned indention on the lower support platform with the lower end resting on the upper surface of the plate. The upper support platform aperture surrounds an intermediate portion of the candlestick thereby preventing the candlestick from being knocked or blown over.

Figure 3:
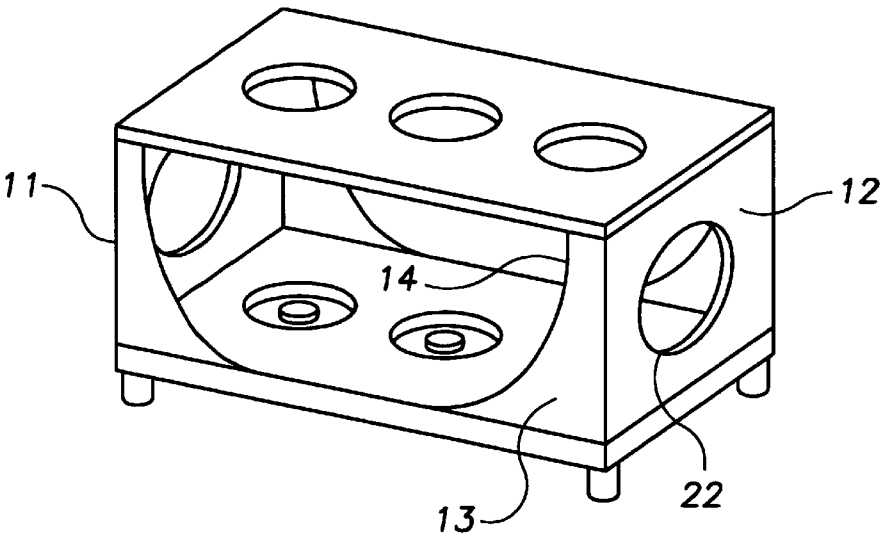
FIG. 3 is a perspective view of a second embodiment.
Figure 2:
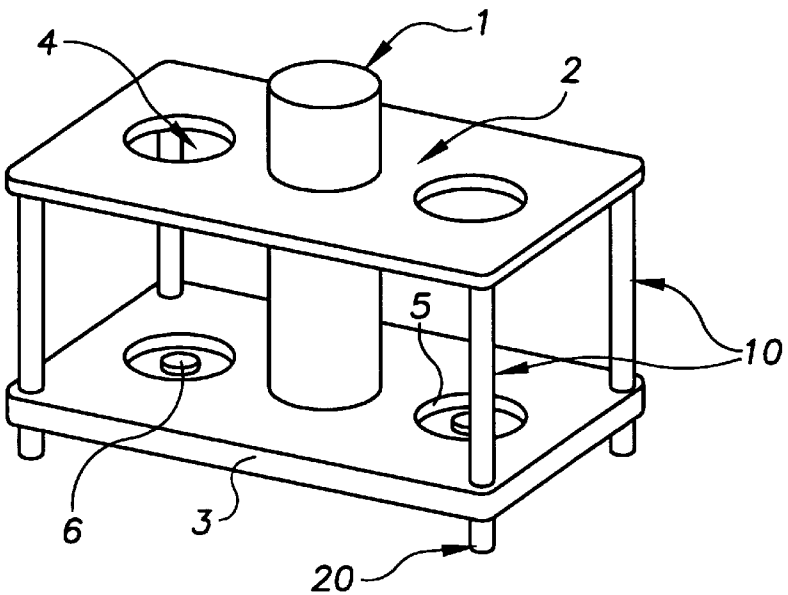
FIG. 2 is a perspective view of a first embodiment.
Figure 4:
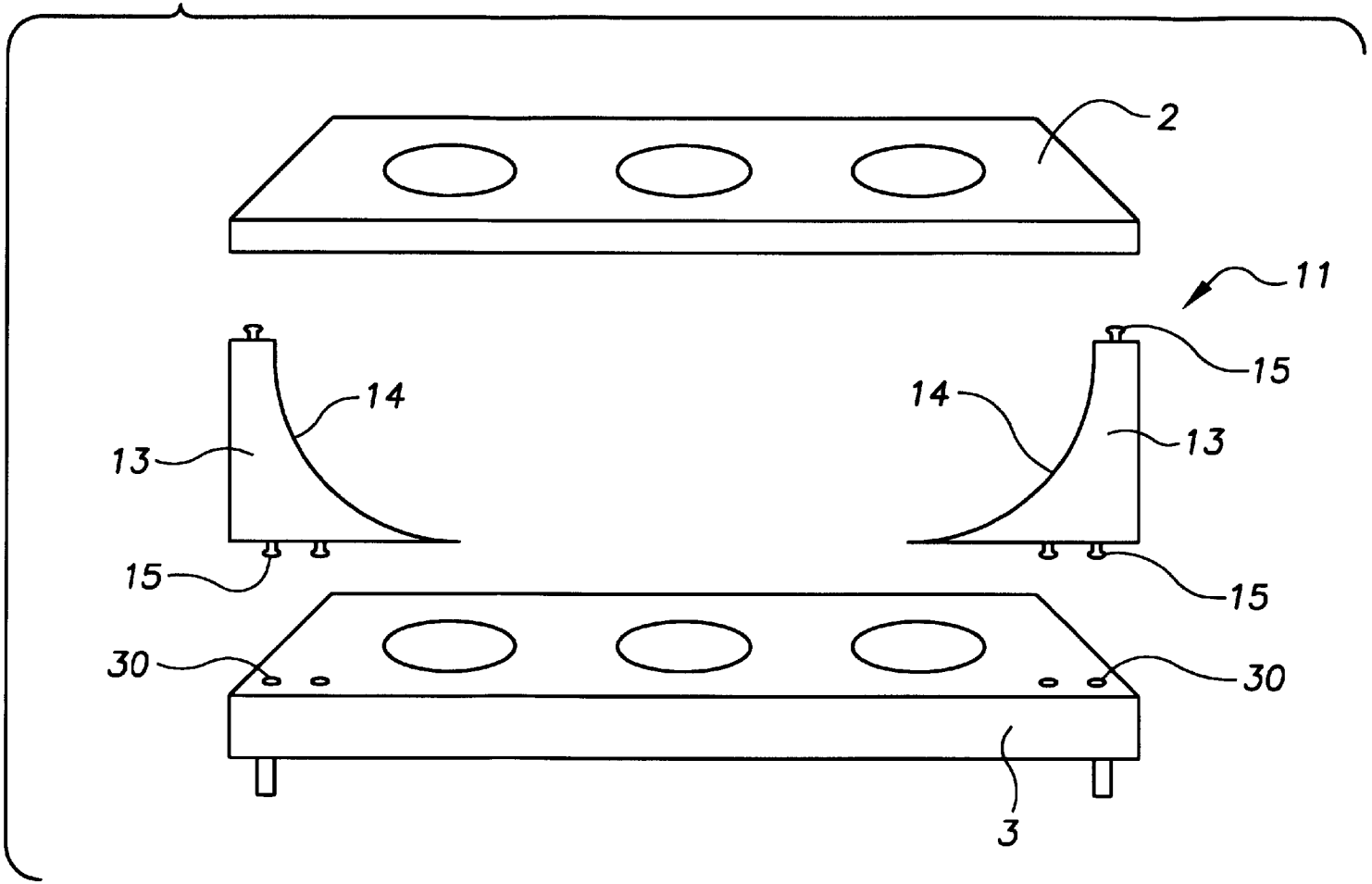
FIG. 4 is an exploded view of the second embodiment.

Now referring to FIGS. 2 through 4, the upper support platform and lower support platform are interconnected with a set of brace members. As depicted in FIG. 2, a first embodiment includes four substantially tubular brace members 10, each extending from a corner of the upper support platform to a corner of the lower support platform. Each brace member is preferably removably attached to both the upper and lower support platform allowing the device to be easily disassembled. The preferable means of removably connecting the tubular brace members includes a protrusion at each end thereof removably received within mating indentions on the respective platforms.

Referring now to FIGS. 3 and 4, a second embodiment is depicted which includes a pair of brace members 11. Each brace member includes an end panel 12 and a pair of side panels 13 perpendicularly extending therefrom. Each side panel has an arcuate edge 14. As depicted in FIG. 4, the brace members include a plurality of protrusions 15 thereon which are received within mating indentions 30 or apertures on the respective support platforms allowing the device to be easily disassembled. The brace members are attached such that the end panel extends from an end of the upper support platform to an end of the lower support platform. The side panels extend from the front or rear edge of the upper support platform to the corresponding edge on the lower support platform. The uniquely configured brace members in the particular embodiment as depicted in FIGS. 3 and 4, provide an aesthetically enhanced candelabra that provides additional structural integrity to the device. The curved side panels minimize any viewing obstruction allowing a user to see each candle when facing either the front or rear of the platforms. Each end panel includes an aperture 22 allowing a user to view a candle from either end of the candelabra, when the device is at substantially eye level. These features are important in that prayer candles often have religious designs, caricatures or other insignia thereon.

The candelabra according to the present invention is constructed with plastic, wood, metal or any other suitable equivalent that provides structural integrity necessary to support a plurality of candlesticks in an upright position. However, as will be readily apparent to those skilled in the art, the size, shape and materials of construction may be varied without departing from the spirit of the present invention.

The above described device is not to be limited to the exact details of construction and arrangement of parts as shown and described. For example, the orientation and shape of the device may be varied to include circular, square or ninety degree platforms for inserting into the corner of a room.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A candelabra comprising:

a lower support platform having an upper surface with a plurality of indentions thereon;

an upper support platform mounted a predetermined distance above said lower support platform, said upper support platform including a plurality of apertures, each of said apertures vertically aligned with a corresponding indention on said lower support platform;

a plate constructed with a heat resistant material received within each of said indentions.

2. The candelabra according to claim 1 further comprising:

a plurality of brace members interconnecting said upper platform with said lower platform.

3. The candelabra according to claim 2 wherein said brace members are removably attached to both said upper support platform and said lower support platform allowing said candelabra to be easily disassembled.

4. The candelabra according to claim 2 wherein said upper and lower support platforms each have four corners and said brace members include a plurality of tubular rods, each rod extending from a corner of said upper platform to a corner of said lower platform.

5. The candelabra according to claim 4 wherein each brace member includes an end panel and a pair of opposing side panels extending from said end panel, said brace member disposed between said upper and lower support platforms.

6. The candelabra according to claim 5 wherein each of said end panels include an aperture allowing a user to see therethrough.

7. The candelabra according to claim 1 wherein each lower support platform includes a bottom surface having a plurality of support legs attached thereto for suspending said lower support platform a predetermined distance above a supporting surface.

8. The candelabra according to claim 5 wherein each side panel includes an arcurate edge to enhance the aesthetic appearance of said candelabra and to allow a user to view candles disposed behind said side panels.

* * * * *